US009476223B2

(12) United States Patent
Bertani

(10) Patent No.: US 9,476,223 B2
(45) Date of Patent: Oct. 25, 2016

(54) BLOCKING DEVICE FOR A DOOR

(75) Inventor: Alberto Bertani, Monza (IT)

(73) Assignee: ELESA S.P.A., Milan (IT)

( * ) Notice: Subject to any disclaimer, the term of this patent is extended or adjusted under 35 U.S.C. 154(b) by 102 days.

(21) Appl. No.: 14/115,478

(22) PCT Filed: May 4, 2012

(86) PCT No.: PCT/IB2012/052244

§ 371 (c)(1),
(2), (4) Date: Nov. 20, 2013

(87) PCT Pub. No.: WO2012/150575

PCT Pub. Date: Nov. 8, 2012

(65) Prior Publication Data

US 2014/0097625 A1 Apr. 10, 2014

(30) Foreign Application Priority Data

May 4, 2011 (IT) ..... M12011A0747

(51) Int. Cl.
*E05C 19/06* (2006.01)
*E05B 15/02* (2006.01)
*E05B 63/00* (2006.01)

(52) U.S. Cl.
CPC ..... *E05B 15/024* (2013.01); *E05B 63/006* (2013.01); *E05C 19/06* (2013.01); *E05C 19/066* (2013.01); *Y10T 292/705* (2015.04)

(58) Field of Classification Search
CPC ..... E05C 7/04; E05C 7/06; E05C 17/02; E05C 17/38; E05C 17/40; E05C 17/46; E05C 17/52; E05C 19/066; E05C 19/06; E05C 19/02; E05C 19/024; E05C 19/04; E05C 19/063; E05C 19/08; E05B 15/0006; E05B 15/02; E05B 15/0205; E05B 15/022; E05B 15/023; E05B 15/0235; E05B 15/024; E05B 15/025; E05B 15/0275; E05B 63/006; Y10T 24/45099; Y10T 24/45257; Y10T 24/45602
USPC ..... 292/14, 17, 19, 70, 76, 80, 81, 87, 79, 292/91, 340, 341, 341.11, 341.12, 341.18, 292/341.19, 300, 304, DIG. 15, DIG. 38, 292/DIG. 56, DIG. 39, DIG. 19, DIG. 40, 292/DIG. 60, DIG. 73, 346, 88, 249, 303; 16/82, 85, 86 B, DIG. 17; 24/598.4, 24/651, 662, 664, 297, 671, 682.1
See application file for complete search history.

(56) References Cited

U.S. PATENT DOCUMENTS 199,451 A * 1/1878 Knowlton ..... 292/70
1,245,617 A * 11/1917 Prinzler ..... 292/341.18
(Continued)

FOREIGN PATENT DOCUMENTS

DE 19013021 A1 9/1970
DE 202010007602 U1 8/2010
(Continued)

OTHER PUBLICATIONS

International Search Report for PCT/IB2012/052244 Jul. 24, 2012.

*Primary Examiner* — Alyson M Merlino
(74) *Attorney, Agent, or Firm* — Pearne & Gordon LLP

(57) ABSTRACT

A device for stable blocking of a rotary or sliding door with respect to a fixed surface or frame, of the type including a male element and a female element, the female element being shaped so as to house the male element and retain it in an easy detachable way. The female element includes a pair of mutually spaced-apart, parallel, elastic wings, projecting from a support base, and the male element includes a substantially spherical knob, having a diameter slightly larger than the distance between the elastic wings, to snap engage between the elastic wings. The base of the female element and/or the knob of the male element includes position adjustment means, for example in the shape of a square wing, and facilitated fastening means, for example in the shape of a single fastening screw.

14 Claims, 3 Drawing Sheets

(56) References Cited

U.S. PATENT DOCUMENTS

| | | | | | |
|---|---|---|---|---|---|
| 1,482,041 | A | * | 1/1924 | Sorenson | 16/86 A |
| 1,829,916 | A | * | 11/1931 | Winans | 16/85 |
| 2,093,465 | A | * | 9/1937 | Claud-Mantle | 292/341.12 |
| 3,061,346 | A | * | 10/1962 | Jorgensen | 292/17 |
| 3,734,551 | A | | 5/1973 | Hughes et al. | |
| 3,752,518 | A | * | 8/1973 | Cannell | 292/42 |
| 4,056,275 | A | | 11/1977 | Keeler, II | |
| 6,629,335 | B1 | * | 10/2003 | Derman | 16/85 |
| 7,431,353 | B1 | * | 10/2008 | Huston | 292/57 |

FOREIGN PATENT DOCUMENTS

| | | | |
|---|---|---|---|
| FR | 2144325 | A5 | 9/1973 |
| JP | 53057099 | U | 5/1978 |
| JP | 60075564 | U | 5/1985 |

* cited by examiner

Fig.1
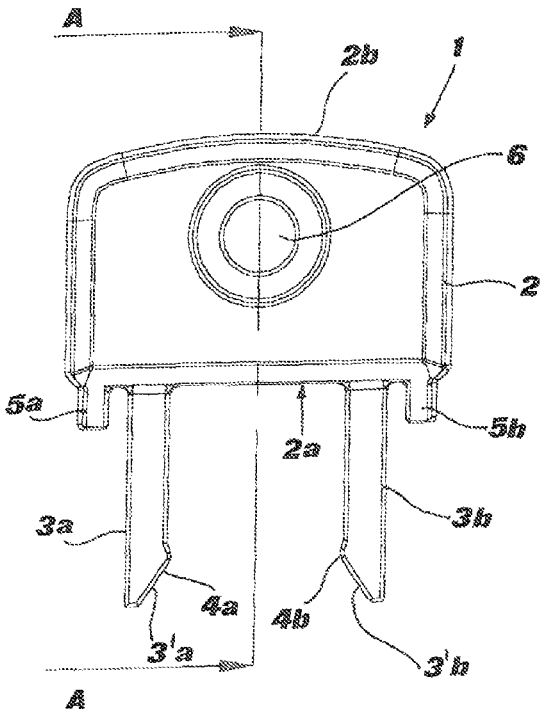
Fig.2
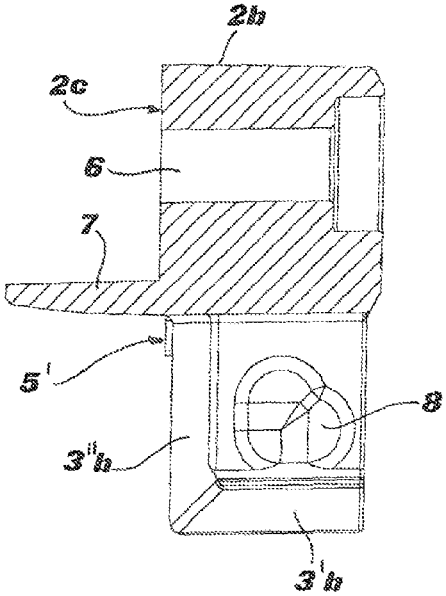
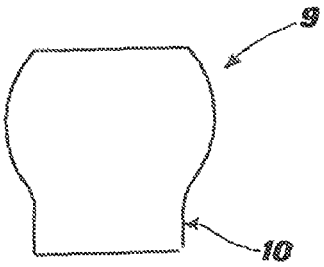
Fig.3
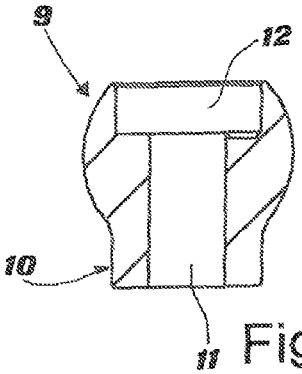
Fig.4
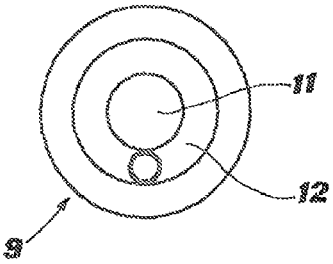
Fig.5

Fig.11
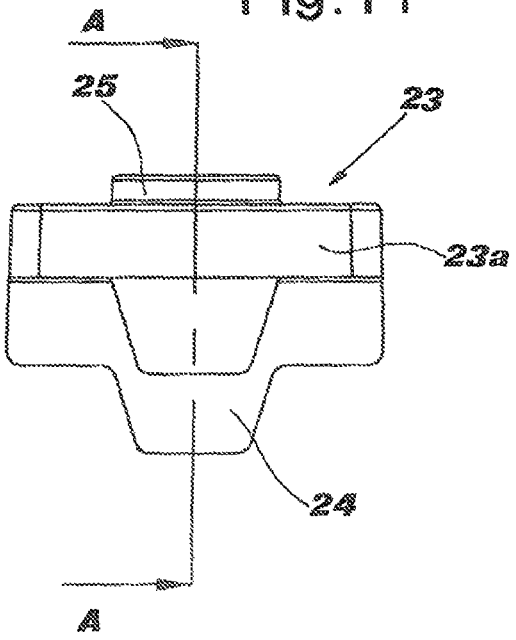
Fig.13
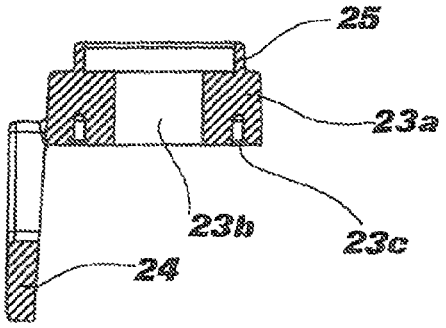
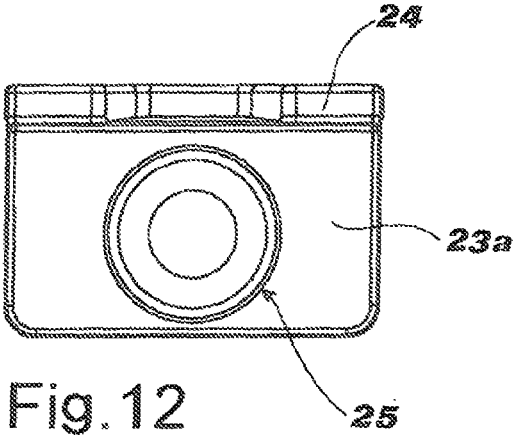
Fig.12

BLOCKING DEVICE FOR A DOOR

This application is a National Stage application of PCT international application PCT/IB2012/052244, filed on May 4, 2012 which claims the priority of European Patent Application No. MI2011A000747 entitled "BLOCKING DEVICE FOR A DOOR", filed with the European Patent Office on May 4, 2011, both of which are incorporated herein by reference in their entirety.

The present invention relates to a so-called "door-blocking" device, that is a device apt to guarantee the stable blocking, but at the same time to allow an easy disengagement, of a door with respect to a surface or a fixed framework, or another door, fastened to the structure whereon both are hinged, for example on the protection of a piece of equipment, on the carter of a machine or on a cabinet.

BACKGROUND

Devices of this kind exist on the market, in particular consisting of a male element and of a female element, wherein at least one of these two elements provides spring-type fastening means, in order to allow the mutual snap engagement, disengageable only by imparting a disengagement force by the operator.

Thus-made prior art structures, useful as they may be, often prove cumbersome, requiring special attention in the manufacturing step, since these devices are of a small size and in extreme environmental conditions may experience jamming, as well as during the installation step, since special attention is needed when recording the mutual position of the various elements.

SUMMARY

It is therefore an object of the present invention to manufacture a new type of door-blocking device, which has such a shape as to allow a safe engagement without it being necessary to provide the use of additional spring-type elements, and which is easily and quickly installed.

A further object is to manufacture a new type of door-blocking device which is not prone to jamming in case of extreme situations, such as for example large accumulations of dust or dirt, which is light and does not add to the door weight, which is resistant to atmospheric elements and which can be used both for doors with hinges and for sliding doors.

The above-said objects are obtained with a blocking device of the type consisting—in a manner known per se—of a male and of a female element shaped so as to elastically fasten one to the other, and having the features mentioned in claim 1. Other preferred features of the invention are highlighted in the dependent claims.

BRIEF DESCRIPTION OF THE DRAWINGS

The features and the advantages of the invention will be in any case more evident from the following detailed description of a preferred embodiment, given purely as a non-limiting example, and illustrated in the attached drawings, wherein:

FIG. 1 shows, in a top plan view, the female element of a first embodiment of the device according to the invention;

FIG. 2 is a section according to the line A-A of FIG. 1;

FIG. 3 is front view of the male element complementary to the female element of FIG. 1;

FIG. 4 is an axial-section view of the male element of FIG. 1;

FIG. 5 is a top plan view of the same male element of FIG. 1;

FIGS. 11, 12 and 13 represent, in an elevation view, top plan view and section view along line C-C, respectively, a spacer supporting the male element.

DETAILED DESCRIPTION

Figure 6:
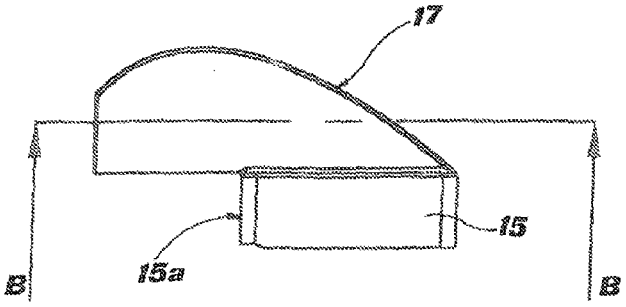
FIG. 6 is a side view of the female element of a second embodiment of the invention.

As shown by FIGS. 1 and 2, the device according to the invention consists, in a first embodiment thereof, of a female element 1, generically consisting of a parallelepiped-shaped body 2, forming a support base, and of a pair of wings 3*a*, 3*b* which project from a planar surface 2*a* of the base. These wings 3*a*, 3*b* are obtained integrally with the base, by moulding of a plastic technopolymer which imparts thereto elastic flexibility features.

As shown in FIG. 1, the terminal edge of these two wings has a bevelling 3'*a*, 3'*b*, forming a flare, on the side facing the space between the two wings; on the same side the bevelling furthermore end with a tooth 4*a*, 4*b* projecting inwards, the function of which is better described in the following. Also at least one of the lateral edges, as shown by FIG. 2, is provided with a flare bevelling 3"*b*. The presence of bevels, 3'*a* 3'*b* and 3"*a* 3"*b* on two perpendicular edges of the wings is meant to guarantee a precise and smooth operation of the device in the two modes, i.e. both with hinged doors and with sliding doors.

Again projecting from the planar surface 2*a* there is provided, outside the pair of wings 3*a*, 3*b*, a pair of parallel dampening ribbings 5*a*, 5*b*; these ribbings are of a slightly greater length than the width of elastic wings 3*a*, 3*b*, so that the terminal portion 5' thereof, protruding by a short measure beyond the lateral edge of the wings—as barely visible in figure 2—are capable of performing an impact dampening function, in the way better described also in the following.

The wall 2*b* opposite to the one wherefrom wings 3*a*, 3*b* project has a slightly arched shape; between walls 2*a* and 2*b* body 2 is formed, substantially parallelepiped-shaped, run through by a single through-hole 6 for the insertion of a single fastening screw (not shown).

As can be observed in FIG. 2, from the planar surface 2*c* of body 2 a square-shaped wing 7 projects perpendicularly, substantially aligned with the cited planar wall 2*a*, wherefrom wings 3*a*, 3*b* project. This square-shaped wing 7—which preferably has a trapezoidal profile both in section (as visible in FIG. 2) and in a top plan view (not shown here)—is apt to accomplish, upon mounting on a fixed portion, a precise positioning of the female element, through the bearing of planes 2*c* and 7 against the two perpendicular surfaces (not shown) of an edge of such fixed portion.

According to a further feature of the invention, on the inner surface of each one of wings 3*a*, 3*b* there is provided a trilobed hollow 8, apt to house—and to maintain in stable engagement, unless a force is imparted to detach the male element 9, which will be better described in the following.

The male element 9, represented in FIG. 3, consists of a knob having a substantially spherical shape, wherefrom two mutually parallel caps are removed. In the place of the lower cap a short stem 10 is provided, while in correspondence of the upper half-sphere—as can be seen in FIGS. 4 and 5—the knob is centrally perforated at 11, for the insertion of a single fastening screw (not shown), the head of which rests in correspondence of widened out hollow 12.

According to the present invention it is furthermore provided—again for the purpose of making the mounting of said male and female elements as easy as possible, in a perfectly adjusted position—a spacer 23, to be arranged between the knob 9 of the male element and the surface of the door whereon the knob is fastened; this is in order to better adjust the knob position with respect to the female element associated with the fixed portion.

Another function of said spacer is to compensate for thickness differences between the post profile and the door profile. As a matter of fact, it is common practice to use reduced-thickness profiles for the door, to make the structure thereof lighter. This requires the installer to manufacture suitable spacers to compensate for such thickness differences. According to the present invention such thickness difference can be compensated for using one or more spacers to be arranged between the knob 9 of the male element and the surface of the door whereon the knob is fastened. As a matter of fact, multiple spacers 23 can be mutually combined due to the interference of the edge 25 of one thereof with the seat 23*c* of another, and to the engagement of squares 24 one on top of the other, which ensures perfect engagement.

As shown in FIGS. 11 to 13, this spacer essentially consists of a base plate 23*a*, which centrally has a perforation 23*b*, for the passing of the only fastening screw (not shown) of the knob 9 of the male element.

From the resting surface (the lower one in the drawing of FIG. 13) of this spacer a square-shaped wing 24 projects downwards, fully similar to the square-shaped wing 7 of FIG. 2, with the function of position adjusting element; this square-shaped wing has a profile—seen in the elevation position of FIG. 11—which is shaped for cooperation with the opposite trapezoidal profile of square-shaped wing 7 of FIG. 2 or with the opposite trapezoidal profile of a further spacer 23, as already described.

In the opposite surface (the upper one in the drawing of FIG. 13), the bottom plate 23*a* is instead formed with an edge seat 25, coaxial with perforation 23*b*, for the support and positioning of the stem 10 of knob 9 and, as already said, for the possible engagement with another spacer 23 through seat 23*c*.

In the second embodiment, illustrated in FIGS. 6 to 10, an alternative layout is provided, meant for the plant not on the edges of a door and of a fixed support portion, respectively, having a full conformation of the usual type, but rather on edges formed by profiles—in particular on the profiles having a central hollow for the fastening with hammer-shaped nuts—wherein said male and female elements are applied with no square abutment.

In this variant two similar male and female constituent elements can be recognized, each one having again a support base 15 and a fastening base 16, respectively, and, projecting therefrom, a pair of elastic wings 17, including individual wings 17*a* and 17*b* forming the female element, and a knob 18 forming the male element, respectively.

As can be observed in FIGS. 6 and 7, the two elastic, mutually parallel wings 17*a* and 17*b*, which depart from support base 15, have an arched profile and project obliquely, or nearly parallel, with respect to the plane of base 15, as far as beyond the free edge 15*a* of said base, for the retaining function of the knob of the male element, as better described in the following.

Figure 7:
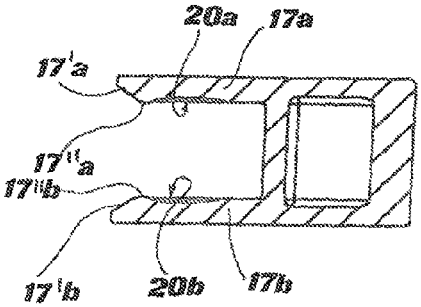
FIG. 7 is a section according to line B-B of FIG. 6.

As can be observed also from FIG. 7, and similarly to what has been mentioned for the embodiment of the drawings 1 to 5, each one of wings 17*a*, 17*b* has at the free end thereof a bevelling shaped like a flare 17'*a*, 17'*b* and ending with a tooth 17"*a*, 17"*b*—to ease the introduction and retaining of the male element 16, 18, described in detail further on—and it further has a trilobed hollow 20*a*, 20*b*, for the housing thereof.

Figure 8:
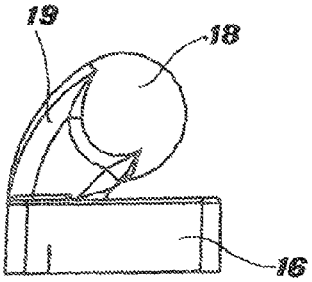
FIG. 8 is a side view of the male element complementary to the female element of FIG. 6.
Figure 9:
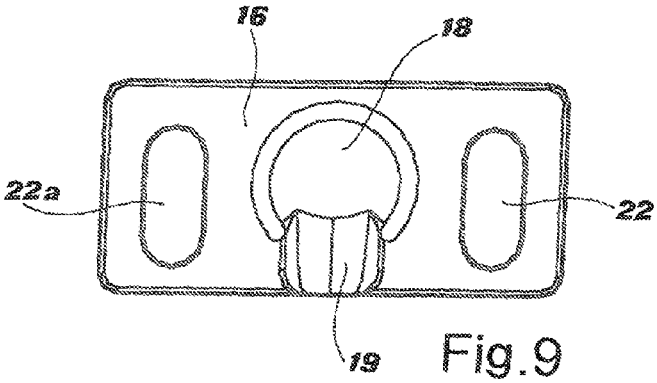
FIG. 9 is a top plan view of the male element of FIG. 8.

The male element illustrated in FIGS. 8 and 9 consists of sphere-shaped knob 18, mounted at the top of a support arm 19, which in turn projects from fastening base 16. Also arm 19 has an oblique development with respect to the plane of base 16, which carries knob 19 to project towards the opposite female element, as better shown in FIG. 10. Knob 18, arm 19 and base 16 are preferably manufactured integrally, by moulding of a technopolymer plastic material.

Both bases 15 and 16 have a flattened shape and each one has—in addition to the male or female elements arranged in a centered position—a pair of holes with parallel, elliptical slits, at the two sides of said centered and mutually opposite elements. On support base 15 the slits are referred to as 21 and 21*a*, while on fastening base 16 they are referred to as 22 and 22*a*, respectively.

Figure 10:
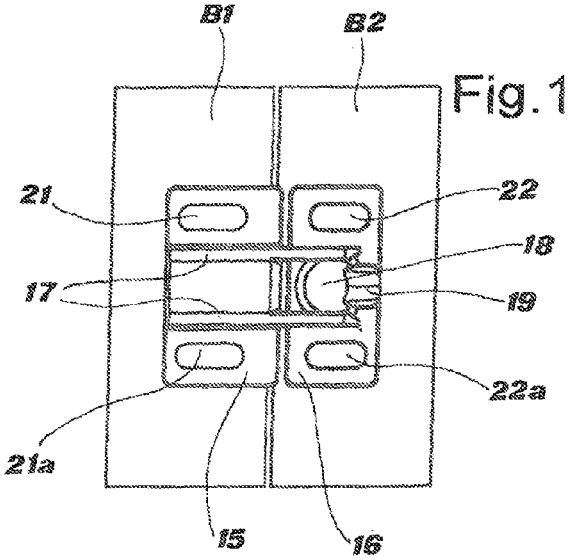
FIG. 10 is a top plan view of the two elements of the second embodiment of the device according to the invention, in a work position.

From FIG. 10 it can be clearly understood how the device appears when it is mounted on the edges B1 and B2 of two opposite doors: the male element 18 engages—upon door closure—between the pair of elastic wings 17 of the female element; these elastic wings 17*a* and 17*b* spread apart elastically enough to allow the access of knob 18 and then close again once the knob is housed in the trilobed hollows suitably provided within the wings.

Such device is manufactured entirely out of a plastic material suitably selected so that it has elastic properties sufficient to guarantee the stability of the engagement between the two female and male elements, and at the same time to allow the disengagement operations when the operator imparts a sufficient traction force on the moving door.

From what has been said above, an extremely easy operation derives. The operator fastens the two male and female elements on the complementary walls, door and fixed portion, in such a mutual position that the engagement thereof is ensured. Subsequently, when one decides to proceed to the closing of the door, one must only impart a slight pressure on the door: the male element arranges itself between the two wings, and—aided by the insertion action of the respective bevellings—arranges itself therebetween, housing itself within the trilobed hollows suitably arranged for the stable positioning thereof and overcoming—in particular in the case of presence of sliding doors—teeth 4*a*, 4*b* or 17"*a*, 17"*b*, respectively, which in that case play a retaining role.

During the closing of the door on the fixed portion the former may come into contact with the latter with a certain inertia and hence with a possible impact of the male portion hitting on the female portion. In order to moderate this impact action and avoid a damage to the elastic wings of the female portion, the terminal portions 5' of said pair of dampening ribbings 5*a*, 5*b* intervene which, by projecting beyond the edge of wings 3*a*, 3*b*, support the impact of the door, preventing the impact from affecting the wings.

Should the operator wish to open the door thus locked, it will be sufficient for him to apply an adequate traction force for overcoming the pushing action of the wings on the male element of the device, and the retaining action due to the trilobed housing hollows and to said teeth.

It can therefore be understood that the device described so far in the two different embodiments thereof fully meets the set objects. In particular a new type of door blocking device with respect to a fixed surface has been manufactured, which does not require the use of additional spring-like elements, the operation of which does not undergo in any way the negative effects intrinsic to the environmental conditions in which it is mounted, and which is easily and quickly installed.

However, it is understood that the invention must not be considered limited to the particular arrangement illustrated above, which represents only an exemplifying embodiment thereof, but that a number of variants are possible, all within the reach of a person skilled in the field, without departing from the scope of protection of the invention, as defined by the following claims.

The invention claimed is:

1. A device for locking a rotary or sliding door with respect to at least one of a surface and a fixed frame, comprising:

a male element and a female element, the female element being shaped so as to house said male element and retain the male element in an easily detachable manner, wherein said female element comprises a pair of parallel, elastic, mutually spaced-apart wings projecting from a support base, and each wing includes an inner surface whereby the inner surfaces of the wings are arranged in an opposed, facing relationship, and wherein said male element comprises a substantially spherical knob having a slightly larger diameter than a distance between said elastic wings, wherein the substantially spherical knob is configured to snap engage between said elastic wings so as to be in engagement with both of said inner surfaces of the wings, wherein the each of the inner surfaces of the wings is defined by two adjacent side edges that each comprise a bevel to facilitate insertion of the male element between the wings from either of said two adjacent side edges, wherein position adjustment means and facilitated fastening means are associated with at least one of said support base of the female element and said knob of the male element, wherein a trilobed hollow for housing at least a portion of said knob of said male element is provided as a recess in the inner surface of each of said elastic wings, wherein each trilobed hollow comprises three lobes, at least one of the lobes being configured to receive and retain the at least a portion of the knob of the male element when the knob is engaged between the elastic wings of the female element, and wherein two of said lobes are each disposed adjacent a corresponding one of the bevels of the adjacent side edges.

2. The device as claimed in claim 1, wherein said position adjustment means and said facilitated fastening means comprise at least one of a square-shaped spacer forming at least one of a position register or resting point and a point of fastening of said knob, said spacer having shaped surfaces for cooperation with opposite elements of said female element.

3. The device as claimed in claim 1, wherein said position adjustment means comprises a square wing projecting from said support base of the female element, said square wing projecting perpendicularly to a resting plane of the support base to form a position register, and wherein a single fastening screw for said support base forms said facilitated fastening means of the female element.

4. The device as claimed in claim 1, wherein said position adjustment means comprises a spacer with a housing seat for said knob of the male element, and wherein a single fastening screw for said support base forms said facilitated fastening means of the male element.

5. The device as claimed in claim 1, wherein said position adjustment means and said facilitated fastening means comprise a fastening base, integral with said knob of the male element, said fastening base is provided with a pair of elongated, slit-shaped holes-having parallel axes and being mutually spaced apart on either side of said knob, and wherein a single fastening screw is associated with each of said holes.

6. The device as claimed in claim 1, wherein said knob of the male element is manufactured integrally with a support arm, wherein the support arm projects integrally from a planar surface of a fastening base of the male element in an oblique direction with respect to a plane of said fastening base.

7. The device as claimed in claim 1, wherein each elastic wing of the female element has a profile which develops into an arc and wherein said elastic wings integrally project from a planar surface of said support base in an oblique direction with respect to a plane of said support base beyond a free edge of the support base.

8. The device as claimed in claim 1, wherein one of the bevels of each wing is a flare beveling facing a space comprised between the elastic wings, wherein the flare beveling aids a spreading apart of said elastic wings upon introduction of said knob of said male element into the space between the elastic wings of said female element.

9. The device as claimed in claim 1, wherein said support base of the female element comprises at least one dampening ribbing-projecting from a resting plane of the support base such that said at least one dampening ribbing extends beyond a flank of each of said elastic wings-and wherein the at least one dampening ribbing is located adjacent to said elastic wings and comprises an end that can cooperate with an opposing abutment surface of said male element.

10. The device as claimed in claim 8, wherein the flare beveling extends to a terminal end of each of said elastic wings.

11. The device as claimed in claim 8, wherein each of said elastic wings comprises a retaining tooth which helps to retain the knob of the male element between the elastic wings and prevent a sliding off of the male element from the female element.

12. The device as claimed in claim 1, wherein each of the elastic wings projects in a substantially perpendicular direction with respect to the support base.

13. The device as claimed in claim 12, wherein each of the elastic wings is substantially planar.

14. The device as claimed in claim 1, wherein the two adjacent side edges are perpendicular to each other.

* * * * *